United States Patent [19]

Vrenken et al.

[11] 4,129,802

[45] Dec. 12, 1978

[54] LOW-PRESSURE MERCURY VAPOR DISCHARGE LAMP

[75] Inventors: Louis E. Vrenken; Franciscus M. P. Oostvogels; Rein W. van der Wolf, all of Eindhoven, Netherlands

[73] Assignee: U.S. Philips Corporation, New York, N.Y.

[21] Appl. No.: 830,650

[22] Filed: Sep. 6, 1977

[30] Foreign Application Priority Data

Sep. 14, 1976 [NL] Netherlands ..... 7610170

[51] Int. Cl.[2] ..... H01J 61/35; H01J 61/42; H01J 61/54

[52] U.S. Cl. ..... 313/492; 313/198; 313/489

[58] Field of Search ..... 313/492, 489, 198; 338/308

[56] References Cited

U.S. PATENT DOCUMENTS

| | | | |
|---|---|---|---|
| 1,984,428 | 12/1934 | Pirani | 315/46 |
| 2,491,854 | 12/1949 | Force | 313/201 X |
| 2,733,371 | 1/1956 | Campbell | 313/185 |
| 3,411,947 | 11/1968 | Block et al. | 338/308 X |
| 3,772,631 | 11/1973 | Owen | 338/195 |
| 3,947,801 | 3/1976 | Bube | 338/308 |

*Primary Examiner*—Palmer C. Demeo
*Attorney, Agent, or Firm*—Robert S. Smith

[57] ABSTRACT

A low-pressure mercury vapor discharge lamp having an internal transmissive starting strip with two separate parts. The separation between the parts is bridged by a narrow straight or helix-shaped conductive connecting strip to bring the total resistance of the starting strip to a value between 50,000 and 150,000 ohms.

5 Claims, 2 Drawing Figures

LOW-PRESSURE MERCURY VAPOR DISCHARGE LAMP

Figure 1:
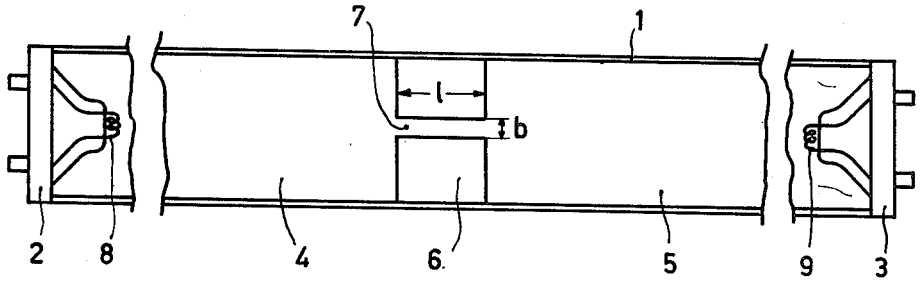

The invention relates to a tubular low-pressure mercury vapour discharge lamp including a discharge tube provided with two electrodes, a luminescent layer on its inner glass wall and an internal light-transmissive conductive coating disposed between this layer and the glass wall and not connected to an electrode, to facilitate starting of the discharge. Such lamps, are, for example, known from U.S. Pat. No. 2,733,371.

Conductive, light-transmissive coatings of the above-described type can be made advantageously from the oxides of tin or indium whose conductivity can be brought to substantially any desired value by "doping" with other elements, for example fluoride, oxygen, indium (for tin) or tin (for indium). For a proper starting, that is to say for a low starting voltage, the total resistance of the coatings, depending on the electrode spacing, must be located, measured from end to end, between 5000 and 500,000 ohm. For these coatings extending over the entire inner surface of the wall this resistance is preferably between 50,000 and 150,000 ohm.

It is possible to apply these coatings for example by means of a spraying process so that these coatings get the desired total resistance and are also properly transmissive to light. When lamps with a power of 40 Watts are used in a number of cases that an unexpectable greying of the combination of the luminescent layer and the conductive coating occurs after only some hundreds of hours. Of course this greying results in loss of light and an unaesthetic appearance, in particular because greying occurs in irregular patches and appear as stains and dots.

This greying is reduced with incrased resistance of the conductive coating. However, when a coating with a high resistance is used this is conflicting with the requirement for a proper starting of the lamp.

This problem of greying can be mitigated by using in accordance with the invention a conductive coating which consists of at least two parts having a resistance per square between 400 and 4000 ohm, which parts are connected in series in the axial direction of the discharge tube by an electrical conductor having such a resistance that the total resistance of the conductive coating and the conductor is between 5000 and 500,000 ohms.

With resistance per square smaller than 400 ohms the coating is too thick and the luminous flux is affected negatively whereas with a value exceeding 4000 ohms starting of the lamp is impeded. In addition, during fabrication of the lamp the application of a stable coating with such a high resistance value is not without problems.

Starting from the inventive idea several solutions can be realized. One of the solutions which is possible is characterized in that the connecting conductor consists of the same material as the parts of the light-transmissive conducting coating but has a higher resistance per square than these parts. Such an embodiment has the advantage that the coating can be applied in a simple manner, for example by means of a spraying process because only one kind of material need be used. Masks can be used to cover those parts which should not be sprayed. An alternative is formed by a method in which the coating which is applied in two more or less separated parts are connected electrically by applying, by means of a writing pen which contains the liquid metal compounds, a line onto the glass wall connecting the two parts and by converting this line by heating into the desired conductive material.

A further solution according to the invention is characterized in that the connecting conductor consists of the same material and has a similar resistance per square as the parts of the conductive layer and effects the required total resistance of the conductive coating and conductor by its dimensions. Such a coating can, for example, be realized by means of a method wherein an uninterrupted conductive layer is first applied, thereafter such portions are removed by means of spark erosion that the desired dimensions of the connecting conductor are produced.

The parts of the conductive coating may be separated by, for example, a gap extending around the tube approximately perpendicularly to the axis of the tubular lamp. In a special embodiment of a lamp according to the invention this gap being bridged by the connecting conductor, characterized in that the connecting conductor consists of at least one connecting strip which extends approximately in parallel with the longitudinal axis of the tube. These strips are then of such a length, width and thickness that the resistance thereof brings the total resistance of the conductive coating within the required values. Also when applying these connecting conductors use can be made of masks which prevent the conductive coating material from reaching the portions which should remain uncoated.

Depending on the material used and the thickness of the connecting conductors the width of the gap between the parts of the conductive coating must be greater or smaller. The gap width must be understood to mean the width of the gap measured across the wall in a direction parallel to the longitudinal axis of the tubular lamp. To avoid a slit which is too wide, which might result in unsatisfactory starting, instead of connecting conductors in parallel with the lamp axis use can be made of another embodiment wherein the connecting conductor is in the form of a helix.

It should be noted that U.S. Pat. No. 1,984,428 discloses a tubular electric mercury vapour discharge lamp whose outside is coated with a wide-mesh net of conductive material. This net is connected to at least one of the electrodes and serves to facilitate starting. In accordance with a special embodiment the net consists of two separate portions, one portion of which is connected directly to an electrode and the other portion, if the electric resistance of the net is insufficient, to the other electrode through a resistor. In addition the two portions of the net are interconnected also through a resistor. No information is given about the value of that resistor nor about its function.

Figure 2:
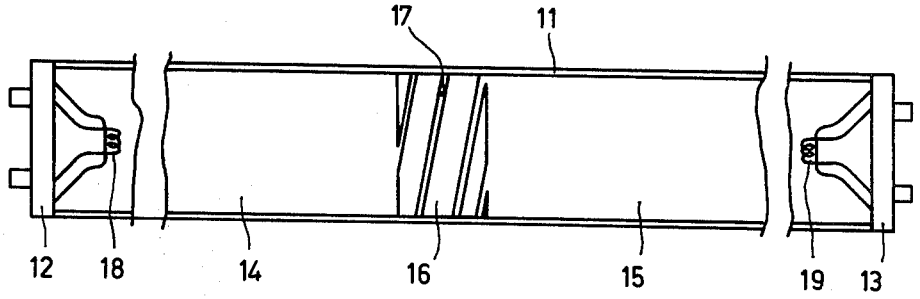

The invention will now be explained in greater detail with reference to a drawing in which:

FIGS. 1 and 2 respectively show side-views of two different embodiments of a low-pressure mercury vapour discharge lamp according to the invention.

In FIG. 1 numeral 1 indicates the glass wall of the envelope of a tubular lamp whose ends are provided with sleeves 2 and 3 respectively in which contact pins are disposed. Disposed on the inner surface of the wall 1 there is a transparent conductive coating, for example consisting of tin oxide doped with indium, consisting of two parts 4 and 5. These parts 4 and 5 having a resistance per square of from 400 to 4000 ohms and cover substantially the entire cylindrical inner side of the tube, except for a gap 6. Only a narrow connecting strip 7 bridges gap 6 and connects the two parts 4 and 5 electrically. By a suitable choice of the length l and the width b of the strip 7 the resistance of the entire conductive coating 4, 5 and 7 together (measured between the ends located near the electrodes) can be brought to the required value of between 5000 and 500,000 ohms. Preferably the strip 7 consists of the same material as the parts 4 and 5 as this presents fewer difficulties during fabrication of the lamp then if the strip 7 were to consist of different material, for example of a different resistance per square, than that of parts 4 and 5. By means of the combination shown of the parts 4 and 5 and the strip 7 the resistance per square of these parts, in particular those of the larger parts 4 and 5 can be chosen such that little greying of the lamp occurs, also after many operating hours; the value desired for a low starting voltage is adjusted by means of the strip 7. The smaller the length and the greater the width of strip 7 the lower, the overall resistance of the combination 4, 5 and 7.

The parts 4 and 5 extend axially to a position adjacent the electrodes 8 and 9 but are not electrically connected thereto.

In the lamp of FIG. 1 a coating of fluorescent powder is disposed on the inside on the conductive parts 4, 5 and 7 and directly on the glass wall in the gap 6. Such a coating may comprise the customary materials, such as calcium halophosphate, activated by maganese and anitmony, manganese-activated magnesium-arsenate and many other materials. The parts 4, 5 and 7 are so transparent that lamps according to the invention can only be distinguished when scrutinized closely from the lamps without a conductive coating or with a conductive coating which extends over the entire tube length.

In a practical example of a 40 Watts lamp of the construction shown in FIG. 1 the distance between the electrodes is 1200 mm, the tube internal diameter is 36 mm, and the tube is filled with some tens of mg of mercury and 2.5 torr of argon). The parts 4, 5 and 7 consist of tin oxide doped with indium, the parts 4 and 5 are so thick that their resistance per square is 400 ohms. The gap 6 whose dimension l is equal to 5 cm is disposed between the two parts 4 and 5. This gap 6 is approximately in the centre of the lamp and is locally bridged by a connecting strip 7 having a length of 5 cm and a width b of 0.4 mm. If the parts 4 and 5 would contact one another the resistance between the ends of the conductive coating would be 4000 ohms. By separating the two parts 4 and 5 and because of the dimensions of the strip 7 the total resistance is, however, 55,000 ohms, that is to say in the desired resistance range of between 5000 and 500,000 ohms.

The lamp described here showed only little greying after 2500 operating hours.

FIG. 2 shows a lamp according to the invention which closely similar to the lamp of FIG. 1. The various parts are indicated as follows:

11 is the glass wall, 12 and 13 are the sleeves provided with connecting pins, 14 and 15 are the parts of the conductive coating and 16 is the uncoated gap between the parts 14 and 15.

The electrodes are indicated by 18 and 19. The difference is that the connecting strip 17 is in the form of a helix and not, as in FIG. 1, in parallel with the lamp axis. For this reason it is possible to make the resistance of the connecting strip 17, as compared to that of FIG. 1, considerably greater. The conductive helix can be realized in a simple manner by removing from an originally uninterrupted conductive coating the helical gap 16 for example by means of spark-erosion.

The gap need not be in the centre of the lamp between the electrodes but may be disposed closer to the one than to the other electrode. Preferably, however, the distance to an electrode is not smaller than 100 mm; since less than this distance results in too high a starting voltage.

A lamp according to the invention may, if necessary, that is to say for a desired total resistance of the conductive layer, have two or even more ring-shaped, bridged gaps 6 or 16.

What is claimed is:

1. A tubular low-pressure mercury vapor discharge lamp which comprises a discharge tube, first and second electrodes disposed within said discharge tube in spaced relationship, a light-transmissive conductive coating disposed on the interior of said discharge tube and not connected to either electrode, and a luminescent layer disposed on at least a portion of the inner surface of said discharge tube, said conductive coating consisting of at least two parts which are axially spaced and which each have a resistance per square between 400 and 4000 ohm, said parts being connected to each axially adjacent part by at least one electrical conductor having such a resistance that the total series resistance of the entire conductive coating is between 5000 and 500,000 ohms.

2. A low-pressure vapor discharge lamp as claimed in claim 1 wherein said electrical conductor consists of the same material as said parts of the light-transmissive conductive coating but has a higher resistance per square than said parts.

3. A low-pressure mercury vapor discharge lamp as claimed in claim 1 wherein said connecting conductor consists of the same material and has a similar resistance per square as the parts of the conductive coating and is suitably dimensioned to produce the total resistance of between 5000 and 500,000 ohms.

4. A low-pressure mercury vapor discharge lamp as claimed in claim 1 wherein said connecting conductor consists of at least one connecting strip, extending approximately parallel to the longitudinal axis of the lamp.

5. A low-pressure mercury vapor discharge lamp as claimed in claim 1 wherein said connecting conductor is helical.

* * * * *

UNITED STATES PATENT AND TRADEMARK OFFICE

CERTIFICATE OF CORRECTION

PATENT NO. : 4129802

DATED : December 12, 1978

INVENTOR(S) : LOUIS EUGENE VRENKEN ET AL

It is certified that error appears in the above-identified patent and that said Letters Patent are hereby corrected as shown below:

Col. 3, line 11, change "then" to --than--

In the Claims:

Col. 4, line 35, after "4000 Ohm," insert -- each of --.

Signed and Sealed this

*Twenty-fifth* Day of *September 1979*

[SEAL]

*Attest:*

*Attesting Officer*

LUTRELLE F. PARKER

*Acting Commissioner of Patents and Trademarks*